United States Patent [19]

Elliston

[11] Patent Number: 4,478,561

[45] Date of Patent: Oct. 23, 1984

[54] HYDRAULIC INTENSIFIER

[75] Inventor: Thomas L. Elliston, Fort Worth, Tex.

[73] Assignee: Hydra-Rig, Incorporated, Fort Worth, Tex.

[21] Appl. No.: 361,602

[22] Filed: Mar. 25, 1982

[51] Int. Cl.[3] ..... F04B 19/02

[52] U.S. Cl. ..... 417/400; 417/454; 417/460

[58] Field of Search ..... 417/400, 454, 460, 467, 417/468, 469

[56] References Cited

U.S. PATENT DOCUMENTS

| | | | |
|---|---|---|---|
| 406,442 | 7/1889 | Hayes | 417/467 |
| 2,318,782 | 5/1943 | Jorgensen | 417/258 |
| 3,263,622 | 8/1966 | Tyree | 417/460 |
| 3,713,755 | 1/1973 | Scheffer | 417/469 |
| 3,801,234 | 4/1974 | Love et al. | 417/454 |

FOREIGN PATENT DOCUMENTS

| | | | |
|---|---|---|---|
| 954841 | 12/1956 | Fed. Rep. of Germany | 417/460 |
| 1528570 | 10/1978 | United Kingdom . | |
| 2006324 | 5/1979 | United Kingdom . | |

*Primary Examiner*—Richard E. Gluck

*Attorney, Agent, or Firm*—Hubbard, Thurman, Turner & Tucker

[57] ABSTRACT

A hydraulic intensifier comprising a stationary working fluid plunger connected to a power fluid cylinder and piston arrangement disposed around the plunger. The power fluid piston is disposed around and integral with a working fluid cylinder member which is reciprocable with respect to the working fluid plunger to displace working fluid from the intensifier. A head member arranged at one end of the plunger includes a cavity for receiving the working fluid discharge valve which is coaxial with the working fluid plunger and in communication with a working fluid cylinder chamber by way of an elongated passage within the plunger. The working fluid inlet valve is disposed in a removable cover member attached to the head of the working fluid cylinder. The power fluid cylinder is removably connected to the head member by a releasable flange clamping connector assemblies. The inlet and discharge valves are accessible through valve covers which are held in assembly with the heads by similar connector assemblies. The power fluid cylinder and working fluid plunger are arranged to be stationary with respect to the working fluid cylinder which is connected to an inlet manifold by way of a flexible conduit to accommodate reciprocating motion of the working fluid cylinder.

18 Claims, 4 Drawing Figures

HYDRAULIC INTENSIFIER

BACKGROUND OF THE INVENTION

1. Field of the Invention

The present invention pertains to a high pressure fluid intensifier having a power piston connected to the working fluid cylinder member and arranged in concentric telescoping relationship around a stationary working fluid plunger.

2. Background Art

There are numerous applications for high pressure hydraulic fluids requiring relatively large and continuous flow rates at extremely high pressure conditions. One such application is in connection with providing high pressure fluids for fracturing subterranean geologic formations to enhance the recovery of petroleum. Geologic formation fracturing and other oil well stimulation techniques often require the injection of exotic hydraulic fluids, some including entrained abrasives, at pressure up to and exceeding 20,000 psi and in fairly large flow rates. These requirements exceed the practical limits for conventional pumping equipment such as reciprocating plunger pumps or high pressure multistage centrifugal pumps.

Accordingly, pumping mechanisms have been developed utilizing hydraulic cylinder or ram actuators for driving the working fluid piston of the so-called fluid end of the pump to produce the high pressure required of the working fluid. By providing a larger diameter piston of the power ram or actuator, this actuator may be operated with power fluid at pressures developed by conventional pumping equipment to produce the high pressure fluid output required of the working fluid pump mechanism. Such devices are conventionally known as intensifiers. Conventional intensifiers are characterized by an arrangement of a power cylinder and piston and a working cylinder and piston arranged end to end with the power piston and working piston rods being common or connected in end to end relationship.

Conventional hydraulic intensifiers have several shortcomings with regard to their use in applications such as those associated with petroleum recovery. The space requirements and weight of conventional intensifiers makes them unattractive for use with the portable equipment for other petroleum recovery operations. The arrangement of the working fluid cylinder chamber, inlet and discharge valving and flow passages has been adapted from conventional pump designs but is not suitable for the higher working pressures required, particularly considering the corrosive and abrasive characteristics of well stimulation and formation fracturing fluids. Moreover, the serviceability of conventional intensifier equipment is generally inadequate and yet must be viewed as an important consideration because of the extreme working conditions to which this type of equipment is subjected. Accordingly, there has been a strongly felt need for improvements in high pressure hydraulic intensifier equipment of the type particularly adapted for use in connection with pumping fluids used to enhance the recovery of petroleum. The advantages of the improved intensifier of the present invention may, however, also be enjoyed in other applications of hydraulic intensifiers.

SUMMARY OF THE INVENTION

The present invention provides an improved hydraulic intensifier characterized by a power cylinder and piston mechanism which is arranged to be concentric and coextensive with the working fluid cylinder and piston or plunger to provide a compact and lightweight unit. In accordance with an important aspect of the present invention, there is provided an intensifier having a working fluid plunger or piston which is connected to a discharge head and support structure and is stationary with respect to a movable working fluid cylinder. The working fluid cylinder member is disposed in concentric telescoping relationship within the power fluid cylinder and may be formed integral with the power fluid piston to provide a remarkably compact structure.

In accordance with another aspect of the present invention, there is provided an improved hydraulic intensifier wherein the structure which includes the working fluid flow passages is adapted to withstand the high working fluid pressures with reduced or uniformly distributed stresses imposed therein. Moreover, the arrangement of working fluid flow path through the working fluid cylinder, as well as the inlet and discharge flow passages, is such as to minimize flow losses and adverse affects of pumping abrasive and corrosive fluids. In accordance with the present invention, the working fluid inlet passages are arranged in a head portion of the movable working fluid cylinder member which contains a suction or inlet valve arranged along the centerline of the working fluid cylinder and plunger mechanism. The working fluid cylinder chamber includes an elongated passage within the interior of the stationary plunger. The working fluid discharge passage includes a discharge valve member disposed in a head connected to one end of the working fluid plunger. Accordingly, this arrangement provides a substantially straight flow path for the working fluid through the intensifier unit, and the flow passages are configured as generally cylindrical concentric passageways within the intensifier structure to minimize stress raisers and changes in flow direction which adversely affect the hydraulic efficiency as well as the mechanical integrity of the structure.

The improved hydraulic intensifier apparatus of the present invention further includes a unique arrangement of a stationary working fluid plunger and power fluid cylinder structure together with a working fluid discharge head and discharge valve cover member. The working fluid plunger head, power fluid cylinder, and a discharge valve cover are all held in assembled relationship with respect to each other by easily removable clamp members which are adapted to withstand high separating forces without distortion of the working parts.

The improved hydraulic intensifier of the present invention also enjoys other advantages including an improved arrangement of a high pressure packing or seal between the working fluid cylinder and plunger which is easily accessible for servicing or replacement without major disassembly of the intensifier unit.

The abovenoted features, as well as several other superior features and advantages of the present invention, will be further appreciated by those skilled in the art upon reading the detailed description which follows in conjunction with the drawings.

DESCRIPTION OF THE PREFERRED EMBODIMENTS

Figure 1:
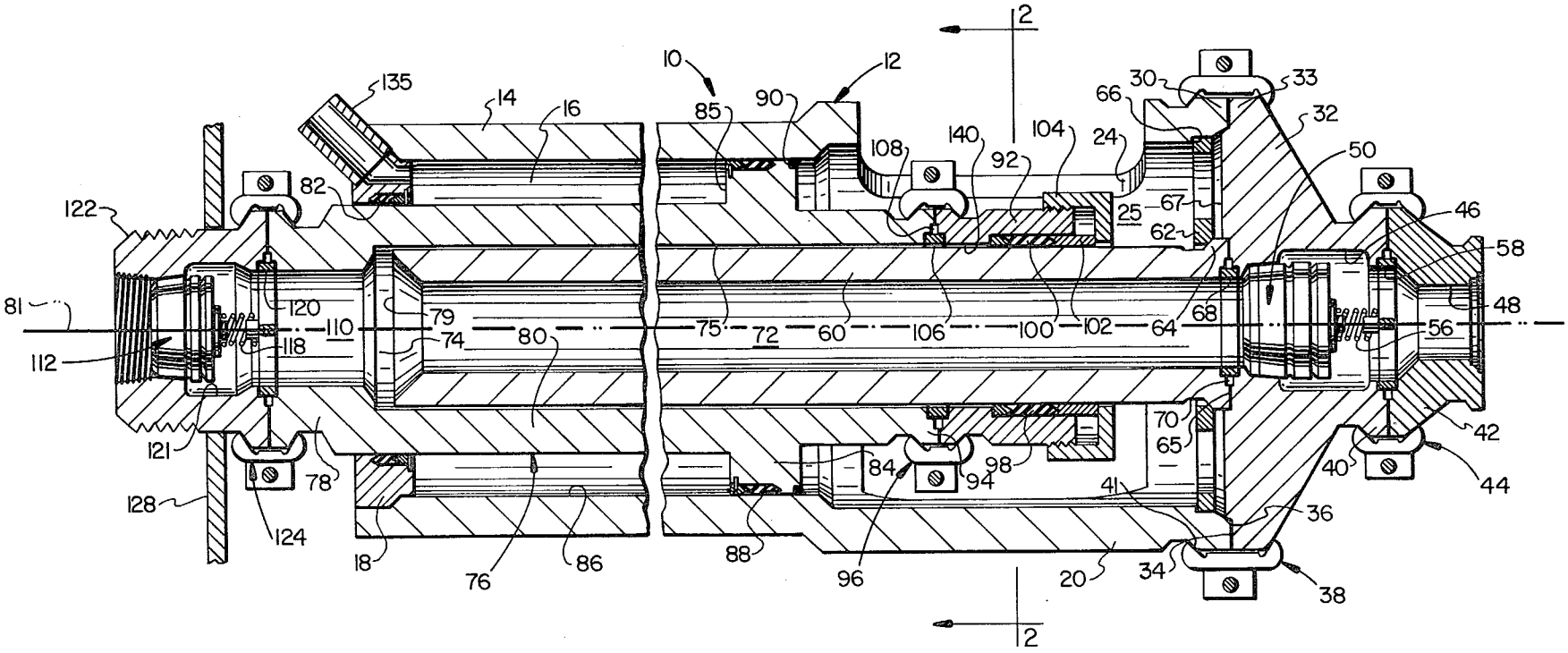
FIG. 1 is a longitudinal central section view of a hydraulic intensifier in accordance with the present invention.

Referring to FIG. 1, in particular, there is illustrated an improved hydraulic intensifier in accordance with the present invention and generally designated by the numeral 10. The intensifier 10 is particularly adapted for use in pumping slurry like fluids at relatively high pressures for injection into subterranean formations to stimulate the production of petroleum. In such applications, working pressures in the range of 15,000 to 25,000 psi are usually required. Moreover, the characteristics of the working fluid being pumped are such that the fluid is particularly corrosive and abrasive. The combination of high working pressures with the fluid physical and chemical characteristics particularly adversely affects pumping equipment. However, several problems relating to the size, weight, and reliability of high pressure intensifiers are believed to be overcome with the arrangement of the intensifier 10.

Figure 2:
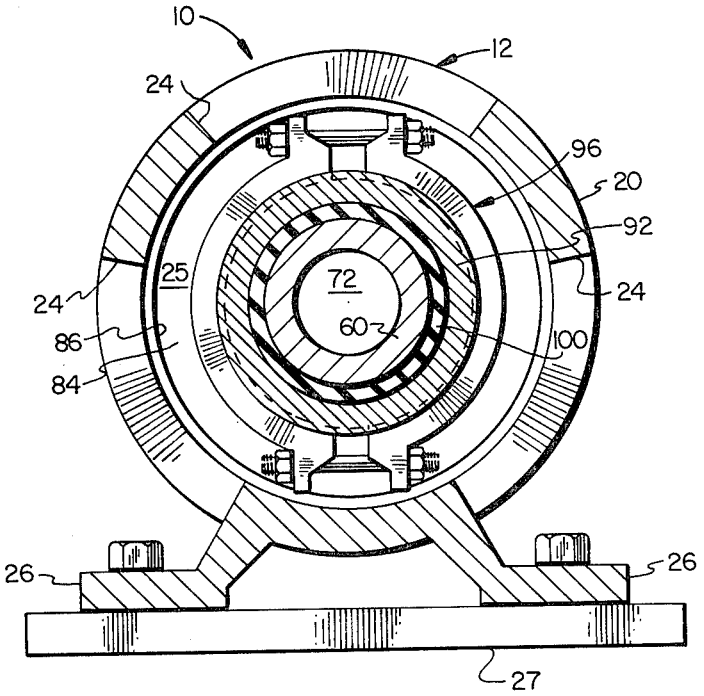
FIG. 2 is a transverse section view taken along the line 2—2 of FIG. 1.
Figure 3:
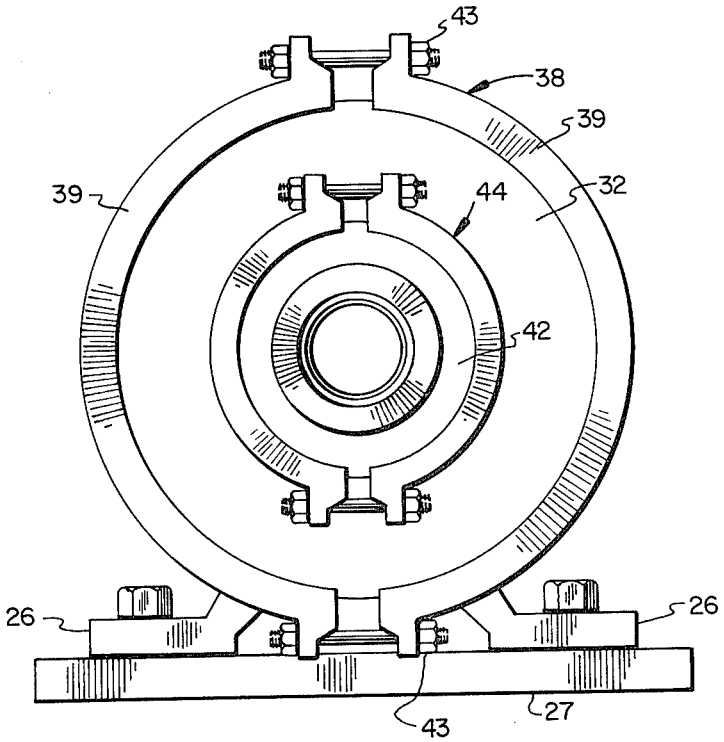
FIG. 3 is an end view taken from the working fluid discharge end of the intensifier shown in FIG. 1.

The intensifier 10 includes an elongated cylindrical housing 12 forming a power fluid cylinder member and having a barrel portion 14 defining an annular power fluid expansible chamber 16. The power fluid cylinder barrel 14 includes a transverse head portion 18 which may be permanently secured to or integrally formed with the cylinder member 12. The cylinder member 12 also includes an elongated spacer part 20 which is also integrally formed with the power fluid cylinder barrel 14. As shown in FIG. 2, the spacer part 20 is formed with three partial circumferential openings 24 to provide access to the interior 25 of the spacer part for a purpose to be described further herein. The housing 12, as shown in FIGS. 2 and 3, also includes suitable mounting flanges 26 for mounting the intensifier 10 on a frame 27.

The cylinder member 12 also includes a circumferential flange portion 30 formed on one end of the spacer part 20 and adapted to be releasably clamped to a cylindrical head member 32 having a peripheral flange portion 33. The head member 32 and the flange 30 are adapted to be releasably clamped together along opposed transverse faces 34 and 36, respectively, by a connector assembly generally designated by the numeral 38. The connector 38 is a multi-part clamping device characterized by a pair of opposed spaced apart partial circumferential clamp members 39 which are formed with circular and somewhat truncated V-shaped grooves 41 cooperable with sloping surfaces on the flanges 30 and 33. The clamp members 39 are suitably secured together by bolt and nut assemblies 43. The connector 38 is of a type which is commercially available and is particularly adapted for bolting cylindrical flanged members together and for withstanding high axial separating forces between the connected parts. The connector assembly 38 is preferably of a type which is manufactured under the trademark GRAYLOC by the Gray Tool Company.

The head member 32 also includes a flange portion 40 similar to the flange portion 33 but of a smaller diameter and adapted to provide for connecting the head member to a removable cover part 42 utilizing a connector assembly 44 similar to the connector assembly 38. The head member 32 is also characterized by a central axially extending cavity 46 which is in communication with a passage 48 formed in the cover part 42. The cavity 46 includes a reduced diameter portion in which is disposed a poppet type valve assembly 50 of the general type utilized in reciprocating plunger pumps. The valve assembly 50 includes a seat member and a poppet type closure member which is biased in the closed position by a coil spring 56 engaged with a valve guide member 58. The guide member 58 is retained in a suitable recess formed by cooperating annular grooves formed in the head member 32 and the cover member 42, as illustrated. The valve assembly 50 and the guide member 58 are typical of reciprocating plunger pump type valve assemblies and are of a type which is commercially available. One source of a valve assembly of the aforementioned type is TRW Mission Mfg. Co. and manufactured as a model P7 pump valve.

Referring still further to FIG. 1, the intensifier 10 includes an elongated cylindrical working fluid piston or plunger member, generally designated by the numeral 60. The plunger 60 is secured to the head member 32 in fluid tight engagement therewith by means of a cylindrical retainer plate 62 which is engageable with an annular flange 64 formed on one end of the plunger 60. The retainer ring 62 is also engaged around its periphery by a shoulder 66 formed by a circumferential groove in the distal end of the spacer part 20, as illustrated. The flange 64 is seated within a pilot bore or locating recess 65 formed in the face 67 of the head member 32. The distal end of the spacer part 20, the recess 65 in the head member 32, the plunger flange 64, and the retainer plate 62 are dimensioned such that when the head member 32 is clamped to the face 34 of the spacer part, the retainer plate forcibly holds the plunger 60 in engagement with the head member 32. The plunger 60 and the head member 32 are also formed with cooperating recesses to retain a seal support and shield ring 68 therebetween for supporting and shielding a fluid tight packing ring 70.

The plunger 60 includes an elongated central bore 72 forming a passage in communication with the valve assembly 50 and with a working fluid chamber, generally designated by the numeral 74, and defined in part by an axially movable working fluid cylinder member, generally designated by the numeral 76. The working fluid cylinder 76 includes an elongated generally cylindrical member having an integral head portion 78 and a cylindrical tubular barrel portion 80. The cylinder barrel portion 80 extends through the head portion 18 and is slidable against a seal or packing 82 disposed within a suitable groove formed in the head portion. The working fluid cylinder 76 includes an integral annular piston part 84 which is slidably disposed in a bore 86 formed in the power fluid cylinder barrel 14 and defining with the cylinder members the expansible chamber 16. The piston 84 is also provided with a suitable fluid seal or packing 88 disposed on the periphery thereof and in slidable but sealing engagement with the bore wall of the cylinder barrel 14. The piston 84 may also be provided with a suitable resilient wiper ring 90.

As may be appreciated by those skilled in the art upon viewing the accompanying drawings, the working fluid cylinder 76 is slidably disposed over the plunger 60 and includes a removable stuffing box 92 which is connected to the inner end 94 of the cylinder 76 by a connector assembly 96 similar in general configuration to the connector assemblies 38 and 44. The stuffing box 92 is provided with an annular recess 98 in which is disposed a suitable piston seal or packing 100. The packing 100 is retained in the recess 98 by a packing gland 102 and a packing nut 104 which is engaged with the stuffing box 92 by cooperating threaded portions formed on each member, respectively. The axial position of the nut 104 may, of course, be adjusted to compress the packing 100 to minimize fluid leakage out of the cylinder chamber 74 between the cylinder bore wall 75 and the plunger 60. The stuffing box 92 and the cylinder end portion 94 are also provided with suitable recesses for supporting a seal ring 106, similar to the ring 68, for retaining and shielding a compressible packing or seal member 108.

The working fluid cylinder 76 includes a fluid inlet passage 110 formed in the head portion 78 which is in communication with an inlet valve assembly 112 similar to the valve assembly 50. A spring 118 biases the closure member of the valve assembly 112 in the closed position and is supported by a valve guide member 120. The valve assembly 112 may, in fact, be identical to the valve assembly 50. The valve assembly 112 is disposed in a cavity 121 forming a part of the inlet passage to the chamber 74 and disposed in a removable cover member 122 which may be releasably secured to the cylinder head portion 78 by a connector assembly 124 similar to the connector 44. The cover member 122 is also provided with an external threaded portion 126 for coupling the cylinder to a working fluid inlet conduit, not shown in FIG. 1. A yoke member 128, partially shown in FIG. 1, is also secured to the cover member 122 and is suitably arranged to be connected to actuators for moving the cylinder 76 in a direction to increase the volume of the expansible chamber 74 and reduce the volume of the expansible chamber 16. The aforementioned actuators will be explained in further detail herein in regard to FIG. 4 of the drawings.

The arrangement of the working fluid cylinder 76 having the annular piston 84 and being disposed in surrounding telescoping relationship with respect to the working fluid plunger 60, provides a particularly compact and lightweight unit which is well suited to use in portable equipment applications. Power fluid for actuating the piston and working fluid cylinder 76 is introduced into the chamber 16 by way of an inlet conduit portion 135. The axial projected area of the piston face 85 is selected to be a multiple of the axially projected area of the end face 79 of the plunger whereby the ratio of the axially projected areas of the face 85 with respect to the face 79 multiplied by the working pressure of the power fluid introduced into the chamber 16 equals the maximum output pressure of the working fluid delivered from the chamber 74. For example, a piston having a net effective face area 85 of 144.71 inches squared and a plunger 60 having an axial projected end face area of 60.13 inches squared, would provide a pressure intensification ratio of approximately 2.407. Therefore, if a working fluid delivery pressure of 20,000 psi were required, the working pressure of the power fluid delivered to the chamber 16 would necessarily be 8300 psi. Accordingly, by providing a suitable source of power fluid to displace the piston 84 through its delivery stroke, considerably higher output pressures may be obtained for the working fluid displaced from the chamber 74 through the discharge valve assembly 50.

The improved intensifier disclosed herein also enjoys particular advantages in handling slurry like fluids by providing a relatively straight flow path of the working fluid through the intensifier unit which minimizes the adverse effects caused by solid particles entrained in the working liquid settling in the working fluid flow passages. Moreover, the arrangement of the inlet and discharge valving disposed coaxial with the longitudinal centerline 81 of the working fluid cylinder and plunger also provides for the design of the components to be such that adverse stress distribution is minimized and stress raisers, such as created by the arrangement of prior art fluid end structures, are avoided.

Another advantage enjoyed by the intensifier 10 pertains to the serviceability of the unit for repair or replacement of the discharge and inlet valve assemblies 50 and 112, respectively. Either valve assembly may be replaced by simply removing the associated connector assembly holding the cover 42 to the head 32 or the cover 122 to the cylinder head portion 78 whereupon the valve closure members may be repaired or replaced or the entire valve assemblies may be easily removed and replaced. The connector assembly 38 also provides for rapid disassembly of the cylinder head 32 with respect to the spacer part 20 whereby access to the plunger 60 may be easily obtained and the plunger itself may be easily removed by simply withdrawing it from the chamber 74 and removing the retainer ring 62. The arrangement of the plunger 60 and the head member 32 is also advantageous in that the working pressures exerted on the plunger 60 urge the plunger in assembly with the head member. Accordingly, the retainer plate 62 is not required to be subjected to substantial stresses resulting from the hydraulic forces exerted on the intensifier.

The connector assembly 96 is easily accessible for removal to remove the stuffing box, if necessary, or to simply slide the stuffing box away from the end of the cylinder 76 whereupon a suitable tool might be inserted in the annular clearance space 140 between the stuffing box and the outside diameter of the plunger to push the packing 100 out of the stuffing box recess 98, once the nut 104 was unthreaded from the stuffing box. Servicing or replacement of the packing 100 does not require disassembly of the head 32 from the spacer part 20.

Figure 4:
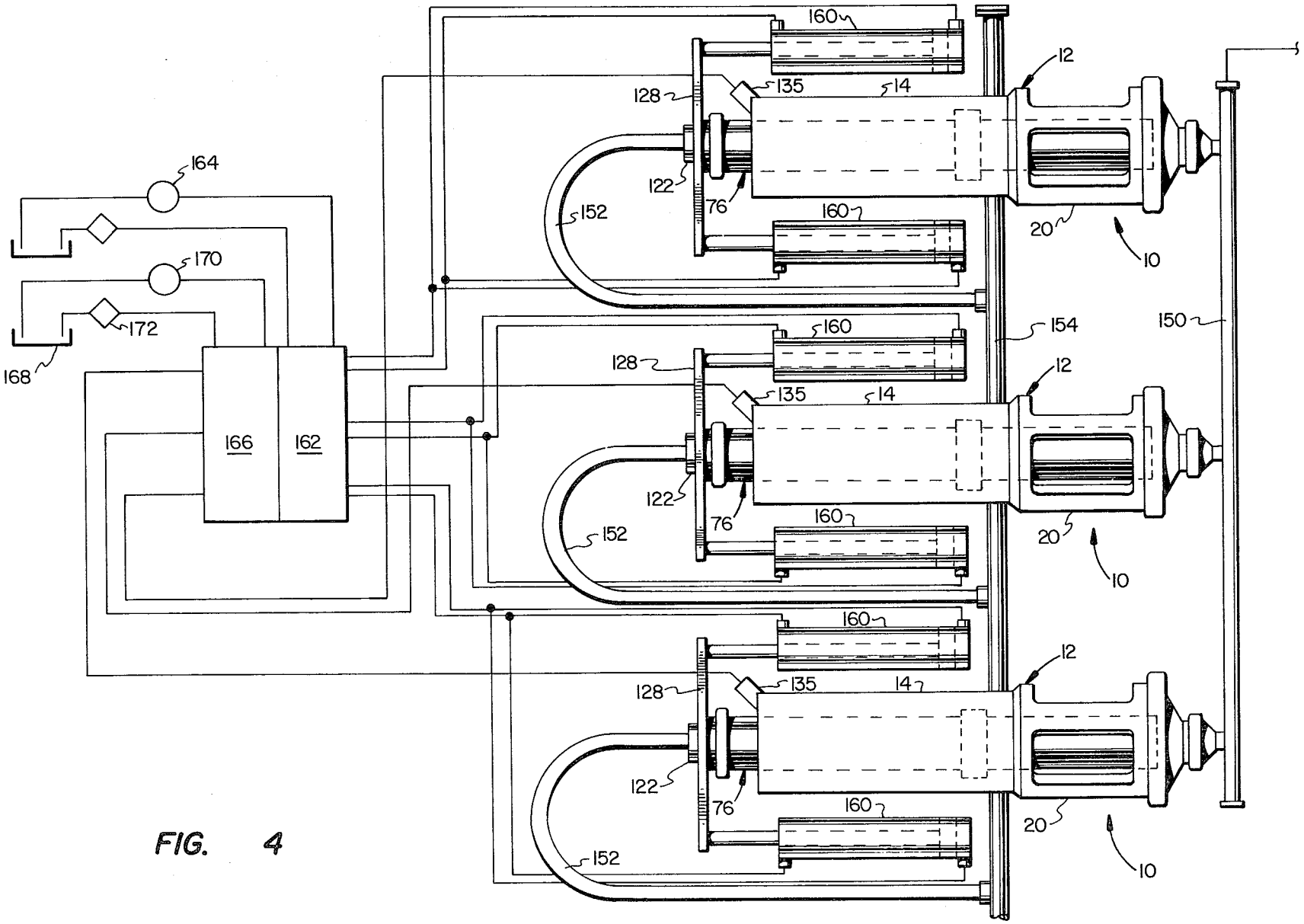
FIG. 4 is a schematic diagram of a triplex arrangement of hydraulic intensifiers in accordance with the present invention.

Referring now to FIG. 4 of the drawings, there is illustrated in somewhat schematic form, a triplex arrangement of the intensifier 10 including three separate intensifier units, as illustrated, all connected to a common discharge manifold 150. The manifold 150 could be adapted to have connecting flanges, not shown, which could be suitably connected to the discharge cover members 42 also utilizing a connector assembly of the type described herein, such as the connector 44. Each of the intensifier units 10 have their inlet end cover members 122 respectively connected to separate flexible inlet conduits 152 which are each bent in approximately a 180° arc and arranged to have their opposite ends connected to a common inlet manifold indicated in schematic form in FIG. 4 and designated by the numeral 154. The manifold 154 is adapted to receive the working fluid from suitable equipment on board a well service truck, for example, which fluid would be premixed to include all of the ingredients including a propant or sand mixture.

Each of the intensifier units 10 also include a pair of pressure fluid actuators 160 arranged to be connected to the yoke 128 on opposite sides of the longitudinal centerline of the respective units for actuating the working fluid cylinders 76 to extend on the inlet stroke to fill the working fluid chambers 74. The cylinders 160 of each intensifier unit 10 are suitably connected to a control valve module 162 for operating the cylinders to extend the working fluid cylinders of each intensifier unit in a predetermined sequence. The control valve module 162 is arranged to receive pressure fluid by way of a pump 164. The actual forces required of the cylinders 160 are not substantial and the source of pressure fluid could be pneumatic or hydraulic. Moreover, once the fluid pressure in the chamber 16 of each intensifier was suitably reduced, and assuming that a suitable charging pressure is provided to the working fluid in the manifold 154, the working fluid cylinders 76 could be moved on their respective inlet strokes by the action of pressure fluid being admitted to the chamber 74 through the inlet valves 112.

Power fluid is supplied to each of the intensifier units 10 by way of a suitable control valve module 166 which is in communication with a source of pressure fluid 168, such as hydraulic oil or water, by way of a pump 170. The power fluid circuit normally also requires heat exchangers such as the power fluid cooler 172 considering the high pressures and flow rates being developed by the power fluid pump 170. The control valve module 166 would be required to emit pressure fluid to the power fluid chambers of the respective intensifier units 10 in predetermined sequence to provide the proper displacement or discharge cycle of the triplex arrangement so that a relatively smooth and pulsation free discharge flow could be obtained in the manifold 150. The valve module 166 is operable to provide high pressure power fluid to each of the power fluid chambers 16 in response to timed shifting of suitable valves, not shown.

As will be appreciated from the foregoing description, the intensifier 10 provides a number of advantages in the art of hydraulic intensifiers or power fluid type pumping apparatus particularly adapted for portable applications, and applications where ease of serviceability is required. Those skilled in the art will recognize that various substitutions and modifications may be made to the specific structural features of the intensifier disclosed herein without departing from the scope and spirit of the appended claims.

What I claim is:

1. A multiple hydraulic intensifier unit for pumping working fluid at a delivery pressure which is a multiple of the working pressure of a power fluid for operating said intensifier unit, said intensifier comprising:

a plurality of hydraulic intensifiers each comprising an elongated stationary power cylinder member having a first head portion at one end and supporting a working fluid plunger, and a second head portion at the opposite end of said power fluid cylinder member;

a reciprocable working fluid cylinder member disposed within said power fluid cylinder member and extending through said second head portion, said working fluid cylinder member including a piston connected thereto, said piston and said second head portion defining with said power fluid cylinder member a power fluid cylinder chamber, said piston being responsive to the introduction of power fluid to said power fluid cylinder chamber to stroke said working fluid cylinder member with respect to said plunger to deliver working fluid from a working fluid chamber formed by said working fluid cylinder member and said plunger;

a working fluid discharge manifold connected to each of said intensifiers for receiving working fluid discharged therefrom;

a working fluid inlet manifold disposed between said first head portions and an end of said working fluid cylinder members extending from said second head portions and at an end of said intensifiers, respectively, opposite said first head portions;

flexible conduit means connected to each of said working fluid cylinder members at said end extending from said second head portions and to said inlet manifold, respectively, for delivering working fluid to each said working fluid chamber;

a source of power fluid; and means for delivering power fluid to each of said intensifiers for stroking said working fluid cylinders to deliver working fluid to said working fluid discharge manifold.

2. The multiple intensifier unit set forth in claim 1 wherein:

each of said intensifiers includes fluid actuator means connected to said working fluid cylinder member at said end extending from said second head portion for moving said working fluid cylinder member in a direction opposite to the working fluid delivery stroke of said working fluid cylinder member, and said intensifier unit includes a source of pressure fluid for operating said each fluid actuator means for causing said each fluid actuator means to move the working fluid cylinders of said intensifiers, respectively, in said opposition direction.

3. A hydraulic intensifier comprising:

a head member including a fluid passage and means for connecting said head member to a fluid flow line;

an elongated working fluid plunger secured to said head member;

a working fluid cylinder member disposed around and in sliding relationship with respect to said plunger and defining with said plunger an expansible working fluid chamber, said working fluid cylinder member including a fluid passage opening into said working fluid chamber;

a power piston connected to said working fluid cylinder member and slidably disposed in an expansible power fluid chamber defined by said power fluid piston and a power fluid cylinder member, said power fluid cylinder member including a spacer part comprising means interconnecting said power fluid cylinder member with said plunger whereby said power fluid cylinder member and said plunger are stationary with respect to each other;

means for releasably securing said spacer part to said hear member comprising respective annular flanges on said spacer part and said head member and a clamp assembly engaging a portion of the circumferential extent of said flanges for securing said spacer part to said head member; and means for conducting power fluid to said power fluid chamber to cause said power piston to stroke said working fluid cylinder member with respect to said plunger to displace working fluid from said working fluid chamber.

4. A hydraulic intensifier comprising:

a head member including a fluid passage and means for connecting said head member to a fluid flow line;

an elongated working fluid plunger including an annular flange formed adjacent one end of said plunger for securing said plunger to said head member;

a working fluid cylinder member disposed around and in sliding relationship with respect to said plunger and defining with said plunger an expansible working fluid chamber, said working fluid cylinder member including a fluid passage opening into said working fluid chamber;

a power piston connected to said working fluid cylinder member and slidably disposed in an expansible power fluid chamber defined by said power fluid piston and a power fluid cylinder member, said power fluid cylinder member including a spacer part comprising means interconnecting said power fluid cylinder member with said plunger whereby said power fluid cylinder member and said plunger are stationary with respect to each other;

means for releasably securing said spacer part to said head member;

a cylindrical retainer plate surrounding said plunger and engageable with said flange, and said spacer part is engageable with said retainer plate for holding said plunger in engagement with said head member when said spacer part and said head member are secured to each other; and means for conducting power fluid to said power fluid chamber to cause said power piston to stroke said working fluid cylinder member with respect to said plunger to displace working fluid from said working fluid chamber.

5. A hydraulic intensifier comprising:

a head member including a fluid passage and means for connecting said head member to a fluid flow line;

an elongated working fluid plunger secured to said head member;

a working fluid cylinder member disposed around and in sliding relationship with respect to said plunger and defining with said plunger an expansible working fluid chamber, said working fluid cylinder member including a fluid passage opening into said working fluid chamber and a head part and a working fluid inlet valve mounted on said head part for admitting working fluid to said working fluid chamber, said plunger including an elongated passage extending from said working fluid chamber to said fluid passage in said head member;

a working fluid discharge valve disposed in said head member and in communication with said fluid passage in said plunger to permit one way flow of working fluid out of said working fluid chamber;

a valve cover member removably secured to said head member and including a working fluid discharge flow passage, and means for connecting said valve cover member to a discharge flow line comprising said fluid flow line;

a power piston connected to said working fluid cylinder member and slidably disposed in an expansible power fluid chamber defined by said power fluid piston and a power fluid cylinder member; and means for conducting power fluid to said power fluid chamber to cause said power piston to stroke said working fluid cylinder member with respect to said plunger to displace working fluid from said working fluid chamber.

6. The intensifier set forth in claim 5 wherein:

said intensifier includes means for connecting said head part to a flexible conduit for conducting working fluid to said working fluid chamber.

7. A hydraulic intensifier comprising:

a head member including a fluid passage and means for connecting said head member to a fluid flow line;

an elongated working fluid plunger secured to said head member;

a working fluid cylinder member disposed around and in sliding relationship with respect to said plunger and defining with said plunger an expansible working fluid chamber, said working fluid cylinder member including a fluid passage opening into said working fluid chamber, a stuffing box disposed at one end of said working fluid cylinder member and around said plunger, a packing disposed in a cavity formed in said stuffing box and engageable with said plunger, and a packing nut threadedly engaged with a packing gland for retaining said packing in said stuffing box;

a power piston connected to said working fluid cylinder member and slidably disposed in an expansible power fluid chamber defined by said power fluid piston and a power fluid cylinder member; and means for conducting power fluid to said power fluid chamber to cause said power piston to stroke said working fluid cylinder member with respect to said plunger to displace working fluid from said working fluid chamber.

8. The intensifier set forth in claim 7 wherein: said stuffing box is releasably connected to one end of said working fluid cylinder.

9. A hydraulic intensifier comprising a power fluid cylinder member defining an expansible power fluid chamber;

a piston slidably disposed in said power fluid chamber and connected to a working fluid cylinder member which is movable with respect to said power fluid cylinder member;

a plunger including an elongated passage formed therein, said plunger being disposed in a working fluid expansible chamber formed in said working fluid cylinder member, said plunger being supported by and secured at one end to a head member connected to said power fluid cylinder member and including passage means in communication with said passage in said plunger;

a working fluid inlet valve mounted on a portion of said working fluid cylinder member;

a working fluid discharge valve mounted in said head member and in communication with said passage in said plunger for discharging working fluid from said working fluid chamber in response to displacement of said piston and said working fluid cylinder member with respect to said plunger; and said head member and said power fluid cylinder member include cooperating flanges formed thereon, and removable clamp means engageable with said flanges for securing said power fluid cylinder member and said head member in assembly.

10. The intensifier set forth in claim 9 wherein:

said plunger includes a peripheral flange formed on one end and engageable with a retainer plate, said retainer plate being engageable by a shoulder formed on said power fluid cylinder member whereby upon securing said power fluid cylinder member to said head member said plunger is secured to said head member.

11. A hydraulic intensifier comprising:

a power fluid cylinder member defining an expansible power fluid chamber;

a piston slidably disposed in said power fluid chamber and connected to a working fluid cylinder member which is movable with respect to said power fluid cylinder member;

a plunger including an elongated passage formed therein, said plunger being disposed in a working fluid expansible chamber formed in said working fluid cylinder member, said plunger being supported by and secured at one end to a head member connected to said power fluid cylinder member and including passage means in communication with said passage in said plunger;

a working fluid inlet valve mounted on a portion of said working fluid cylinder member;

a working fluid discharge valve mounted in said head member and in communication with said passage in said plunger for discharging working fluid from said working fluid chamber in response to displacement of said piston and said working fluid cylinder member with respect to said plunger; and a valve cover member releasably secured to said head member by cooperating flanges formed on said cover member and said head member and removable clamp means engageable with said flanges.

12. A hydraulic intensifier comprising:

a power fluid cylinder member defining an expansible power fluid chamber;

a piston slidably disposed in said power fluid chamber and connected to a working fluid cylinder member which is movable with respect to said power fluid cylinder member;

a plunger disposed in a working fluid expansible chamber formed in said working fluid cylinder member, said plunger being supported by a member connected to said power fluid cylinder member;

an elongated passage formed in said plunger;

a working fluid inlet valve mounted in an inlet valve housing removably mounted on said working fluid cylinder member and including passage means in communication with said working fluid chamber, said inlet valve housing and said working fluid cylinder member including cooperating flanges and removable clamp means engageable with said flanges for holding said inlet valve housing in assembly with said working fluid cylinder member; and a working fluid discharge valve in communication with said passage in said plunger for discharging working fluid from said working fluid chamber in response to displacement of said piston and said working fluid cylinder member with respect to said plunger.

13. A hydraulic intensifier comprising:

a power fluid cylinder member defining an expansible power fluid chamber;

a piston slidably disposed in said power fluid chamber and connected to a working fluid cylinder member which is movable with respect to said power fluid cylinder member;

a plunger disposed in a working fluid expansible chamber formed in said working fluid cylinder member, said plunger being supported by a member connected to said power fluid cylinder member;

an elongated passage formed in said plunger;

a working fluid inlet valve mounted on a portion of said working fluid cylinder member;

a stuffing box removably secured to one end of said working fluid cylinder member by cooperating flanges on one end of said stuffing box and said one end of said working fluid cylinder member, respectively, and removable clamp means engageable with said flanges for securing said working fluid cylinder member in assembly with said stuffing box; and a working fluid discharge valve in communication with said passage in said plunger for discharging working fluid from said working fluid chamber in response to displacement of said piston and said working fluid cylinder member with respect to said plunger.

14. The intensifier set forth in claim 13 wherein:

said power fluid cylinder member includes a cylinder barrel part defining said power fluid chamber and a spacer part including means at one end for connecting said power fluid cylinder member to said member supporting said plunger, said spacer part being adapted to provide access to said stuffing box without disassembling said power fluid cylinder member from said member supporting said plunger.

15. The intensifier set forth in claims 9, 11, 12 or 13 wherein:

said removable clamp means comprises a pair of opposed partial circumferential clamp members each provided with a circular V-shaped groove engageable with cooperable opposed surfaces on said flanges, respectively, and threaded bolt means for securing said clamp members to each other to hold said respective flanges forcibly secured together.

16. A hydraulic intensifier comprising:

a head member including a fluid passage and means for connecting said head member to a fluid flow line;

an elongated working fluid plunger secured to said head member;

a working fluid cylinder member disposed around and in sliding relationship with respect to said plunger and defining with said plunger an expansible working fluid chamber, said working fluid cylinder member including a fluid passage opening into said working fluid chamber;

a power piston connected to said working fluid cylinder member and slidably disposed in an expansible power fluid chamber defined by said power fluid piston and a power fluid cylinder member;

said power fluid cylinder member including means for connecting said power fluid cylinder member to said head member, and a spacer part interposed between said power fluid chamber and said means for connecting said power fluid cylinder member to said head member, said spacer part defining an opening therein for access to one end of said working fluid cylinder member;

plunger seal means disposed on said one end of said working fluid cylinder member and in fluid sealing engagement with said plunger, and means for retaining said seal means on said one end of said working fluid cylinder member; and means for conducting power fluid to said power fluid chamber to cause said power piston to stroke said working fluid cylinder member with respect to said plunger to displace working fluid from said working fluid chamber.

17. The intensifier set forth in claim 16 together with:

means for stroking said working fluid cylinder member in the direction opposite to that which displaces working fluid from said working fluid chamber.

18. The intensifier set forth in claim 17 wherein:

said means for stroking said working fluid cylinder member in said opposite direction comprises separate pressure fluid cylinder means connected to said working fluid cylinder member.

* * * * *

UNITED STATES PATENT AND TRADEMARK OFFICE

CERTIFICATE OF CORRECTION

PATENT NO. : 4,478,561

DATED : October 23, 1984

INVENTOR(S) : Thomas L. Elliston

It is certified that error appears in the above-identified patent and that said Letters Patent is hereby corrected as shown below:

In Claim 3, Col. 8, line 62, "hear" should be --head--.

Signed and Sealed this

*Twenty-third* Day of *April 1985*

[SEAL]

*Attest:*

DONALD J. QUIGG

*Attesting Officer* *Acting Commissioner of Patents and Trademarks*